US006394635B1

(12) United States Patent
Temme et al.

(10) Patent No.: US 6,394,635 B1
(45) Date of Patent: May 28, 2002

(54) PLASTIC COVER PLATE MOTOR VEHICLE HEADLIGHTS

(75) Inventors: Ulrich Temme, Lippstadt; Rudolf Zehe, Delbrueck, both of (DE)

(73) Assignee: Hella KG Hueck & Co., Lippstadt (DE)

( * ) Notice: Subject to any disclaimer, the term of this patent is extended or adjusted under 35 U.S.C. 154(b) by 0 days.

(21) Appl. No.: 09/584,377

(22) Filed: May 31, 2000

(30) Foreign Application Priority Data

Jun. 1, 1999 (DE) ..... 199 25 049

(51) Int. Cl.[7] ..... F21V 1/00

(52) U.S. Cl. ..... 362/509; 362/507; 362/311; 106/287.1; 106/287.16

(58) Field of Search ..... 362/509, 520, 362/507, 311; 106/287.16, 287.1

(56) References Cited

U.S. PATENT DOCUMENTS 4,329,738 A * 5/1982 Heinz et al. ..... 362/61
4,992,306 A * 2/1991 Hochberg et al. ..... 427/255.3
6,000,814 A * 12/1999 Nestell et al. ..... 362/267

FOREIGN PATENT DOCUMENTS

| | | |
|---|---|---|
| DE | 2100262 | 7/1972 |
| DE | 2443718 | 4/1975 |
| DE | A-3084042 | 4/1991 |
| DE | A1-4128547 | 3/1993 |
| DE | A1-19713508 | 10/1998 |

* cited by examiner

*Primary Examiner*—Sandra O'Shea
*Assistant Examiner*—Bertrand Zeade
(74) *Attorney, Agent, or Firm*—Birch, Stewart, Kolasch & Birch, LLP

(57) ABSTRACT

The present invention provides a plastic cover plate for motor vehicle lights, such as motor vehicle headlights. The plastic cover plate is characterized in that the plate has, on the surface facing towards the light, a transparent coating to prevent specks from forming through the non-homogeneous deposition of dust.

14 Claims, 1 Drawing Sheet

PLASTIC COVER PLATE MOTOR VEHICLE HEADLIGHTS

This application claims a foreign priority based on German patent application 199 25 049.9, filed Jun. 1, 1999, and the disclosure in that application is expressly incorporated by reference herein.

FIELD OF THE INVENTION

The present invention relates to plastic cover plates for motor vehicle headlights or other motor vehicle lights.

BACKGROUND OF THE INVENTION

The manufacture of motor vehicle headlights and motor vehicle lights on the basis of thermoplastic raw materials has been known for a long time. In recent years, plastic cover plates made of polycarbonate have found wide acceptance. However, in actual vehicular usage, specking has been observed on the inside of the plastic plates, that is, on the surface facing the light source. This involves essentially dust deposits, which cause a disruptive impairment within systems that are not completely closed.

In a ventilated system of a motor vehicle headlight or light, the flecks are caused especially by a varying vaporization of additives in the thermoplastic materials. In operation, temperatures ranging from 120 to 125° C. can occur in the plastic plate. At sites which are especially hot, greater vaporization of the additives takes place than occurs in the colder zones. Here, possibly, traces of the additives settle, so that the inner surface no longer has the same static properties throughout. In this way, variable dust deposition occurs.

The purpose of the invention presented here consists in preventing specking, which is obviously disruptive, especially in non-profile, clear cover plates of motor vehicle headlights. Of course, efforts have been made among the manufacturers, who manufacture the raw materials for the production of plastic plates, to develop plastics, which prevent specking through corresponding material components. However, these material combinations, as they are described for example in DE 197 13 508 A1, are not completely satisfactory.

For transparent thermoplastics, internal antistatic agents, which are added to the raw material, cannot be used without impairing properties of the cover plate material. Externally applied antistatic agents are effective only temporarily, and are affected the air humidity present in the light assembly.

SUMMARY OF THE INVENTION

The aforementioned purpose—the prevention of specking—is achieved in a first embodiment form through a plastic plate of a motor vehicle headlight or motor vehicle light, which is characterized in that the plate has, on the surface facing towards the light, a transparent coating to prevent specks from forming through a non-homogeneous deposition of dust.

Using the invention presented here, a non-visible, completely transparent coating is thus made available for the inner surface of plastic plates of motor vehicle headlights or motor vehicle lights, which in the installed condition are no longer accessible for cleaning and because of electrostatic charging, tend to collect dust particles in the form of specks that are thus obvious decoratively.

With the aid of the invention presented here, it was discovered that this dust deposition can then be prevented especially when the coating is made of $SiO.SiO_2(Si_2O_3)$. This material, whose fundamental application is known for the manufacture of a reflection reducing layer on lenses, is used according to the present invention primarily in the sector of the motor vehicle industry. Surprisingly, it has been discovered that very thin layers of this material, for example, 5 to 100 nm, in particular, 25 to 50 nm, are suitable for preventing flecking to the greatest extent possible.

The application of the coating occurs according to processes described in the state of the art, as are disclosed, for example, in the patent DE 41 28 547 A1, the entire contents of which are hereby expressly incorporated by reference.

BRIEF DESCRIPTION OF THE DRAWINGS

The invention is illustrated by the accompanying, non-limiting drawings. It is noted that the drawings are not to scale.

DESCRIPTION OF PREFERRED EMBODIMENTS

Figure 1:
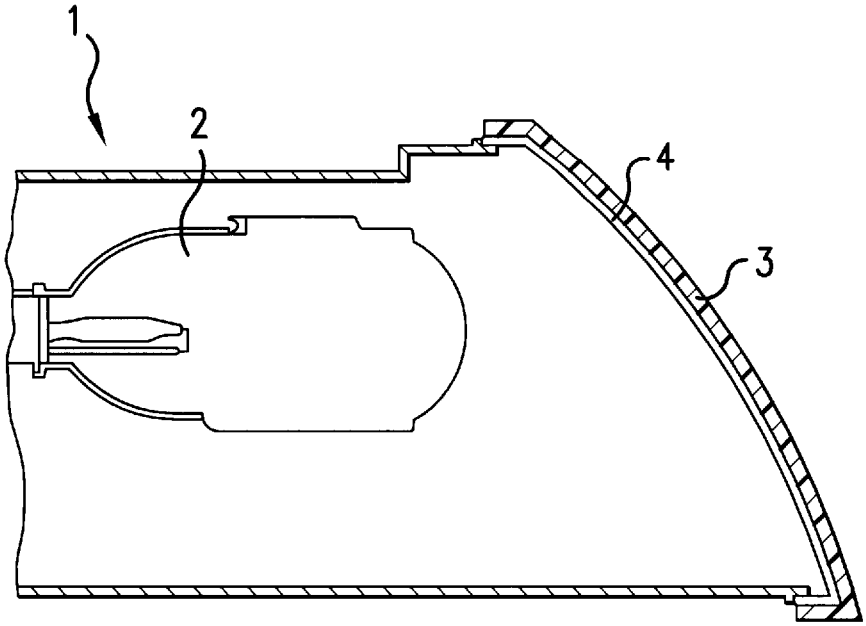
FIG. 1 is a partial side schematic drawing of an embodiment of the present invention.
Figure 2:
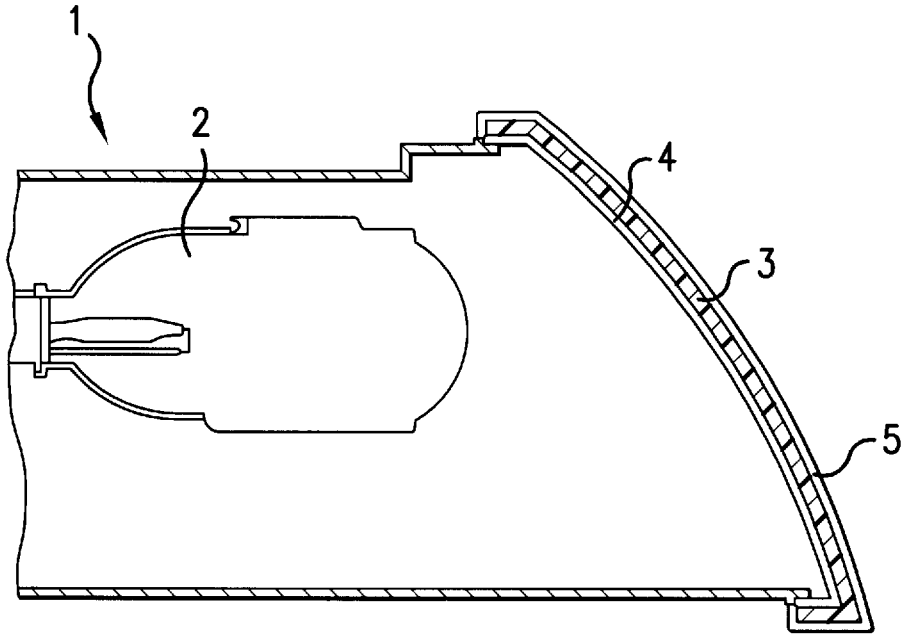
FIG. 2 is a partial side schematic drawing of another embodiment of the present invention.

Referring to FIGS. 1 and 2, the present invention provides a motor vehicle light assembly 1—preferably a headlight assembly—comprising a light source 2 and a transparent plastic cover plate 3 having a surface facing towards the light source and a surface that faces away from the light source, wherein said surface facing towards the light source is covered by a transparent coating layer 4 to prevent specks from forming through the non-homogeneous deposition of dust.

Although any transparent plastic that is sufficiently hard can be used for a cover plate in accordance with this invention, it is currently preferred that the plate be composed of polycarbonate.

The motor vehicle light assembly cover plate of the present invention may have a hardcoat-coating 5 on the surface that faces away from the light.

The dust-free coating layer described herein comprises $Si_2O_3$, and may consist essentially of $SiO.SiO_2$ $(Si_2O_3)$. This coating layer is effective in thicknesses in the range of 5 to 100 nm. A preferred thickness range is 25 to 50 nm.

Another aspect of the present invention is a process for the manufacture of a transparent plastic cover plate for a motor vehicle light assembly. This process comprises the step of applying a layer of $Si_2O_3$ onto a surface of the cover plate facing towards the light source by vacuum evaporation of SiO.

A special embodiment form of the invention presented here consists in manufacturing the coating by physical vapor deposition (PVD), chemical vapor deposition (CVD), or plasma enhanced chemical vapor deposition (PECVD), in particular by vaporization of SiO.

EXAMPLE 1

A plastic cover plate is brought into a vacuum chamber/coating system containing SiO directly after the injection molding. The outside of the plate and the plate edge area (plate base), functioning in the subsequent assembly progression for sealing/adhesion, was covered in advance using a template. After reaching a vacuum in the range of 3–7× $10^{-4}$ mbar, vaporization of the SiO occurs. This leads to coating with a $Si_2O_3$ layer of the inner surface of the plate. The processing time is with the range of 15 to 30 minutes.

Following this process, the plate inner side has a non-visible, fully transparent layer. This layer acts as a blocking layer for the additive that generally diffuses out of the plastic, in this example, polycarbonate. Furthermore, this layer is electrostatically neutral, so that the charging typical for polycarbonate can no longer occur. Both in laboratory tests as well as in a driving test with real motor vehicle headlights, it was observed that flecks or fleck-shaped dust deposition no longer occurred on this layer.

EXAMPLE 2

The manufacturing procedure of Example 1 was repeated, with, however, the plastic plate being coated on the outside with a hardcoat layer prior to the coating with $Si_2O_3$. The advantage in this procedure was that the outer plate of the plate did not have to be additionally covered anymore in the vacuum process.

While this invention has been described with reference to particular specific embodiments, the principles of the present invention are capable of wide variations that will readily occur to those skilled in the art.

What is claimed is:

1. A motor vehicle light assembly comprising a light source and a transparent plastic cover plate, said cover plate having a surface facing towards the light source and a surface that faces away from the light source, wherein the cover plate surface facing towards the light source is covered by a transparent coating layer, comprising $Si_2O_3$ and having a thickness of 5 to 100 nm, to prevent specks from forming through the non-homogeneous deposition of dust.

2. The motor vehicle light assembly of claim 1, wherein said light assembly is a headlight assembly.

3. The motor vehicle light assembly of claim 1, wherein said plate is composed of polycarbonate.

4. The motor vehicle light assembly of claim 1, wherein said plate has a hardcoat-coating on the surface that faces away from the light.

5. The motor vehicle light assembly of claim 1, wherein said coating layer comprises $SiO.SiO_2(Si_2O_3)$.

6. The motor vehicle light assembly of claim 1, wherein thickness of the coating layer is 25 to 50 nm.

7. A process for the manufacture of a transparent plastic cover plate for a motor vehicle light assembly, said cover plate having a surface facing towards a light source and a surface that faces away from a light source, wherein the cover plate surface facing towards the light source is covered by a transparent coating layer, said process comprising the step of applying a layer of $Si_2O_3$ onto said surface facing towards the light source by vacuum evaporation of SiO.

8. The process of claim 7, wherein said motor vehicle light assembly is a headlight assembly and said transparent coating layer comprises $SiO.SiO_2(Si_2O_3)$.

9. The process of claim 7, wherein the $Si_2O_3$ application step is effected by a vacuum evaporation process selected from the group consisting of PVD, CVD, and PECVD.

10. A motor vehicle light assembly comprising a light source and a transparent plastic cover plate, said cover plate having a surface facing towards the light source and a surface that faces away from the light source, wherein the cover plate surface facing towards the light source is covered by a transparent coating layer having a thickness of 5 to 100 nm to prevent specks from forming through the non-homogeneous deposition of dust.

11. The motor vehicle light assembly of claim 10, wherein said light assembly is a headlight assembly.

12. The motor vehicle light assembly of claim 10, wherein said plate is composed of polycarbonate.

13. The motor vehicle light assembly of claim 10, wherein said plate has a hardcoat-coating on the surface that faces away from the light.

14. The motor vehicle light assembly of claim 10, wherein thickness of the coating layer is 25 to 50 nm.

* * * * *